US010652667B2

(12) United States Patent
Fort et al.

(10) Patent No.: US 10,652,667 B2
(45) Date of Patent: May 12, 2020

(54) CONTROLLING A LINK FOR DIFFERENT LOAD CONDITIONS

(71) Applicant: Cochlear Limited, Macquarie University, NSW (AU)

(72) Inventors: Andrew Fort, Leuven (BE); Werner Meskens, Opwijk (BE)

(73) Assignee: COCHLEAR LIMITED, Macquarie University, NSW (AU)

( * ) Notice: Subject to any disclaimer, the term of this patent is extended or adjusted under 35 U.S.C. 154(b) by 110 days.

(21) Appl. No.: 15/698,952

(22) Filed: Sep. 8, 2017

(65) Prior Publication Data

US 2017/0374475 A1 Dec. 28, 2017

Related U.S. Application Data

(62) Division of application No. 14/030,614, filed on Sep. 18, 2013, now Pat. No. 9,820,061.

(60) Provisional application No. 61/789,799, filed on Mar. 15, 2013.

(51) Int. Cl.
*H04R 25/00* (2006.01)

(52) U.S. Cl.
CPC ..... *H04R 25/43* (2013.01); *H04R 25/554* (2013.01); *H04R 2420/01* (2013.01); *H04R 2420/03* (2013.01)

(58) Field of Classification Search
CPC .. H04R 25/43; H04R 25/554; H04R 2420/01; H04R 2420/03
See application file for complete search history.

(56) References Cited

U.S. PATENT DOCUMENTS

| | | | | |
|---|---|---|---|---|
| 4,419,995 | A | 12/1983 | Hochmair et al. | |
| 6,067,474 | A | 5/2000 | Schulman et al. | |
| 6,212,431 | B1 | 4/2001 | Hahn et al. | |
| 6,745,077 | B1 * | 6/2004 | Griffith | A61N 1/08 607/61 |
| 6,992,543 | B2 | 1/2006 | Luetzelschwab et al. | |
| 8,106,628 | B2 | 1/2012 | Kobayashi et al. | |
| 2005/0077872 | A1 | 4/2005 | Single | |
| 2005/0285546 | A1 | 12/2005 | Price et al. | |
| 2010/0225408 | A1 | 9/2010 | Rofougaran et al. | |
| 2012/0109256 | A1 | 5/2012 | Meskens et al. | |
| 2012/0309295 | A1 | 12/2012 | Maguire | |
| 2013/0108091 | A1 * | 5/2013 | Stoffaneller | A61N 1/3787 381/315 |

FOREIGN PATENT DOCUMENTS

| | | | |
|---|---|---|---|
| WO | 2008144860 | A1 | 12/2008 |
| WO | 2010114666 | A1 | 10/2010 |

* cited by examiner

*Primary Examiner* — Nafiz E Hoque
(74) *Attorney, Agent, or Firm* — Edell, Shapiro & Finnan, LLC

(57) ABSTRACT

The present disclosure relates generally to devices, systems, and methods for supporting different load conditions in a data/power link. In one example, a device includes a transformer that has a first tap with a first turns ratio and a second tap with a second turns ratio. The device further includes electronics and circuitry. The circuitry is configured to selectively couple the electronics to the first tap of the transformer for a first application and to couple the electronics to the second tap of the transformer for a second application.

21 Claims, 4 Drawing Sheets

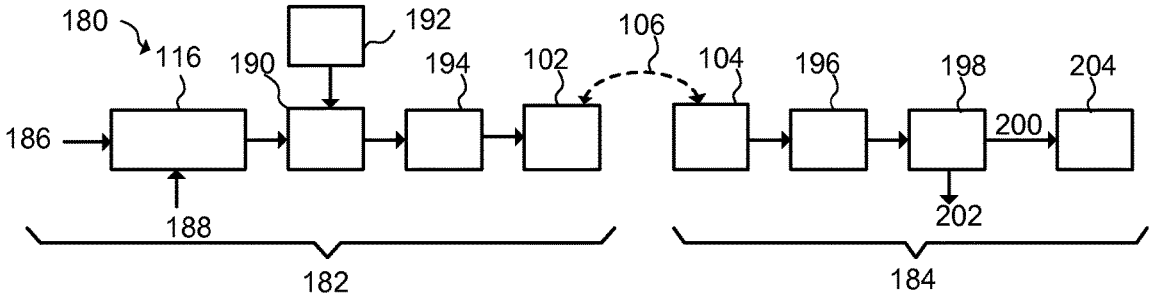
FIG. 4
FIG. 5
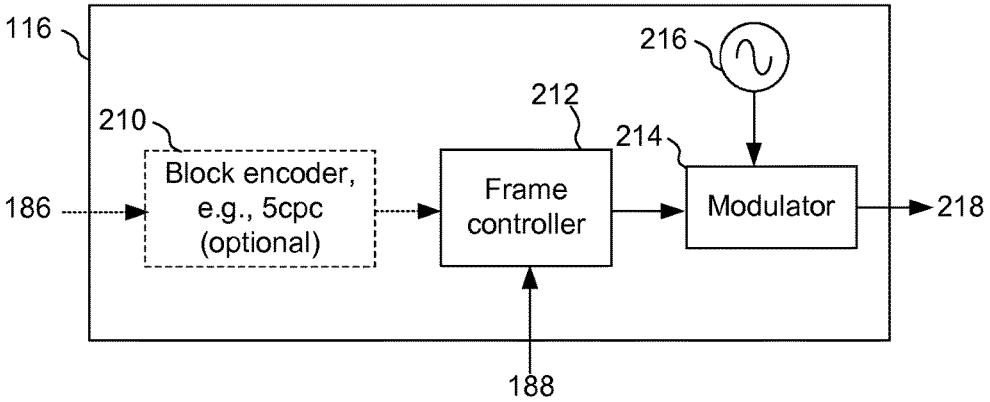
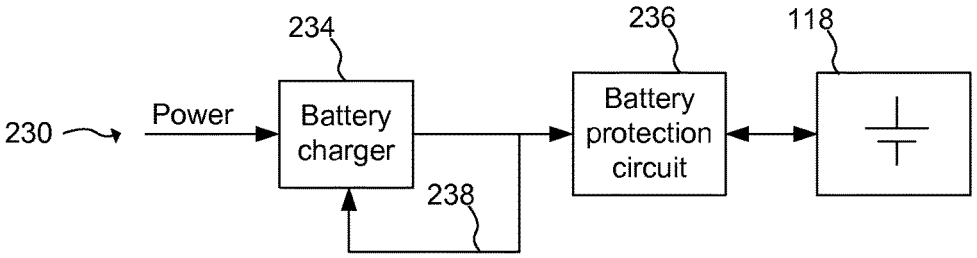
FIG. 6
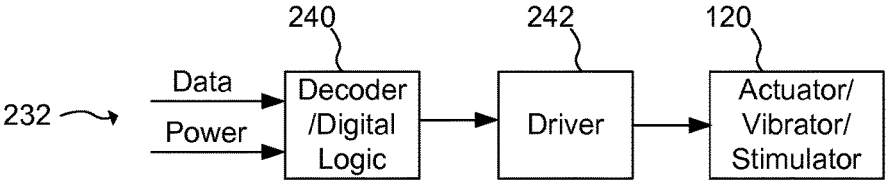

CONTROLLING A LINK FOR DIFFERENT LOAD CONDITIONS

CROSS-REFERENCE TO RELATED APPLICATIONS

This application is a divisional application of U.S. patent application Ser. No. 14/030,614, entitled "Controlling a Link for Different Load Conditions," filed on Sep. 18, 2013, which in turn claims benefit of U.S. Provisional Patent Application No. 61/789,799, entitled "Controlling a Link for Different Load Conditions," filed on Mar. 15, 2013. The above applications are hereby incorporated by reference herein in their entireties.

BACKGROUND

Various types of hearing prostheses provide persons with different types of hearing loss with the ability to perceive sound. Hearing loss may be conductive, sensorineural, or some combination of both conductive and sensorineural. Conductive hearing loss typically results from a dysfunction in any of the mechanisms that ordinarily conduct sound waves through the outer ear, the eardrum, or the bones of the middle ear. Sensorineural hearing loss typically results from a dysfunction in the inner ear, including the cochlea where sound vibrations are converted into neural signals, or any other part of the ear, auditory nerve, or brain that may process the neural signals.

Persons with some forms of conductive hearing loss may benefit from hearing prostheses such as acoustic hearing aids or vibration-based hearing devices. An acoustic hearing aid typically includes a small microphone to detect sound, an amplifier to amplify certain portions of the detected sound, and a small speaker to transmit the amplified sounds into the person's ear. Vibration-based hearing devices typically include a small microphone to detect sound and a vibration mechanism to apply vibrations corresponding to the detected sound directly or indirectly to a person's bone or teeth, thereby causing vibrations in the person's inner ear and bypassing the person's auditory canal and middle ear. Vibration-based hearing devices include, for example, bone anchored devices, direct acoustic cochlear stimulation devices, or other vibration-based devices. A bone-anchored device typically utilizes a surgically implanted mechanism or a passive connection through the skin or teeth to transmit vibrations corresponding to sound via the skull. A direct acoustic cochlear stimulation device also typically utilizes a surgically implanted mechanism to transmit vibrations corresponding to sound, but bypasses the skull and more directly stimulates the inner ear. Other non-surgical vibration-based hearing devices may use similar vibration mechanisms to transmit sound via direct or indirect vibration of teeth or other cranial or facial bones or structures.

Persons with certain forms of sensorineural hearing loss may benefit from implanted prostheses such as cochlear implants and/or auditory brainstem implants. For example, cochlear implants can provide a person having sensorineural hearing loss with the ability to perceive sound by stimulating the person's auditory nerve via an array of electrodes implanted in the person's cochlea. A component of the cochlear implant detects sound waves, which are converted into a series of electrical stimulation signals that are delivered to the implant recipient's cochlea via the array of electrodes. Auditory brainstem implants can use technology similar to cochlear implants, but instead of applying electrical stimulation to a person's cochlea, auditory brainstem implants apply electrical stimulation directly to a person's brain stem, bypassing the cochlea altogether. Electrically stimulating auditory nerves in a cochlea with a cochlear implant or electrically stimulating a brainstem may enable persons with sensorineural hearing loss to perceive sound. Further, some persons may benefit from hearing prostheses that combine one or more characteristics of acoustic hearing aids, vibration-based hearing devices, cochlear implants, and auditory brainstem implants to enable the person to perceive sound.

Some hearing prostheses include separate units or elements that function together to enable the person to perceive sound. In one example, a hearing prosthesis includes a first element that is generally external to the person and a second element that can be implanted in the person. In the present example, the first element is configured to detect sound, to encode the detected sound as acoustic signals, to deliver the acoustic signals to the second element over a coupling or link between the first and second elements, and/or to deliver power to the second element over the link. The second element is configured to apply the delivered acoustic signals as output signals to the person's hearing system and/or to apply the delivered power to one or more components of the second element. The output signals applied to the person's hearing system can include, for example, audible signals, vibrations, and electrical signals, as described generally above.

The coupling or link between the first and second elements can be a radio frequency (RF) link operating in the magnetic or electric near-field, for example, and can be utilized to operate the hearing prosthesis in one or more modes, such as applying output signals to the person's hearing system and charging a power supply of the hearing prosthesis. In general, different operating modes of the hearing prosthesis may represent different load conditions that affect the efficiency of the coupling between the first and second elements. In various examples, the efficiency of the coupling can be optimized for a load condition of a particular operating mode or optimized for an average load condition of a plurality of operating modes, which results in a compromise design of the hearing prosthesis. Generally, it is desirable to improve on the arrangements of the prior art or at least to provide one or more useful alternatives.

SUMMARY

The present application discloses devices, systems, and methods for controlling a data and/or power coupling for different load conditions of a device or system. In one example, the coupling is configured to transfer electrical signals to deliver power with or without encoded data. Further, in various non-limiting examples, the system can be directed to a hearing prosthesis, such as a cochlear implant, a bone anchored device, a direct acoustic cochlear stimulation device, an auditory brain stem implant, an acoustic hearing aid, or any other type of hearing prosthesis configured to assist a recipient in perceiving sound.

Generally, the present disclosure is directed to a system for transmitting and receiving electrical signals over a communication link for different load conditions. The system is configured with impedance matching capabilities for efficiently providing the electrical signals for the different load conditions. The impedance matching capabilities can be implemented by one or more stages of impedance matching. These one or more stages can generally be characterized by a coarse correction and a fine-tuning correction, as will be described in more detail hereinafter. Illustratively, the one or more stages of impedance matching can utilize impedance transformation circuits and/or duty cycle adjustments.

BRIEF DESCRIPTION OF THE DRAWINGS

FIG. 4 illustrates a block diagram of first and second elements of a system according to an embodiment of the present disclosure.

FIG. 5 illustrates a block diagram of a signal generator of FIG. 4 in accordance with an embodiment of the present disclosure.

FIG. 6 illustrates a block diagram of a variable load corresponding to first and second operating modes of a system.

DETAILED DESCRIPTION

The following detailed description sets forth various features and functions of the disclosed devices, systems, and methods with reference to the accompanying figures. In the figures, similar symbols typically identify similar components, unless context dictates otherwise. The illustrative embodiments described herein are not meant to be limiting. Certain aspects of the disclosed devices, systems, and methods can be arranged and combined in a variety of different configurations, all of which are contemplated herein. For illustration purposes, some features and functions are described with respect to hearing prostheses. However, various features and functions disclosed herein may be applicable to other types of devices, including other types of medical and non-medical devices.

Figure 1:
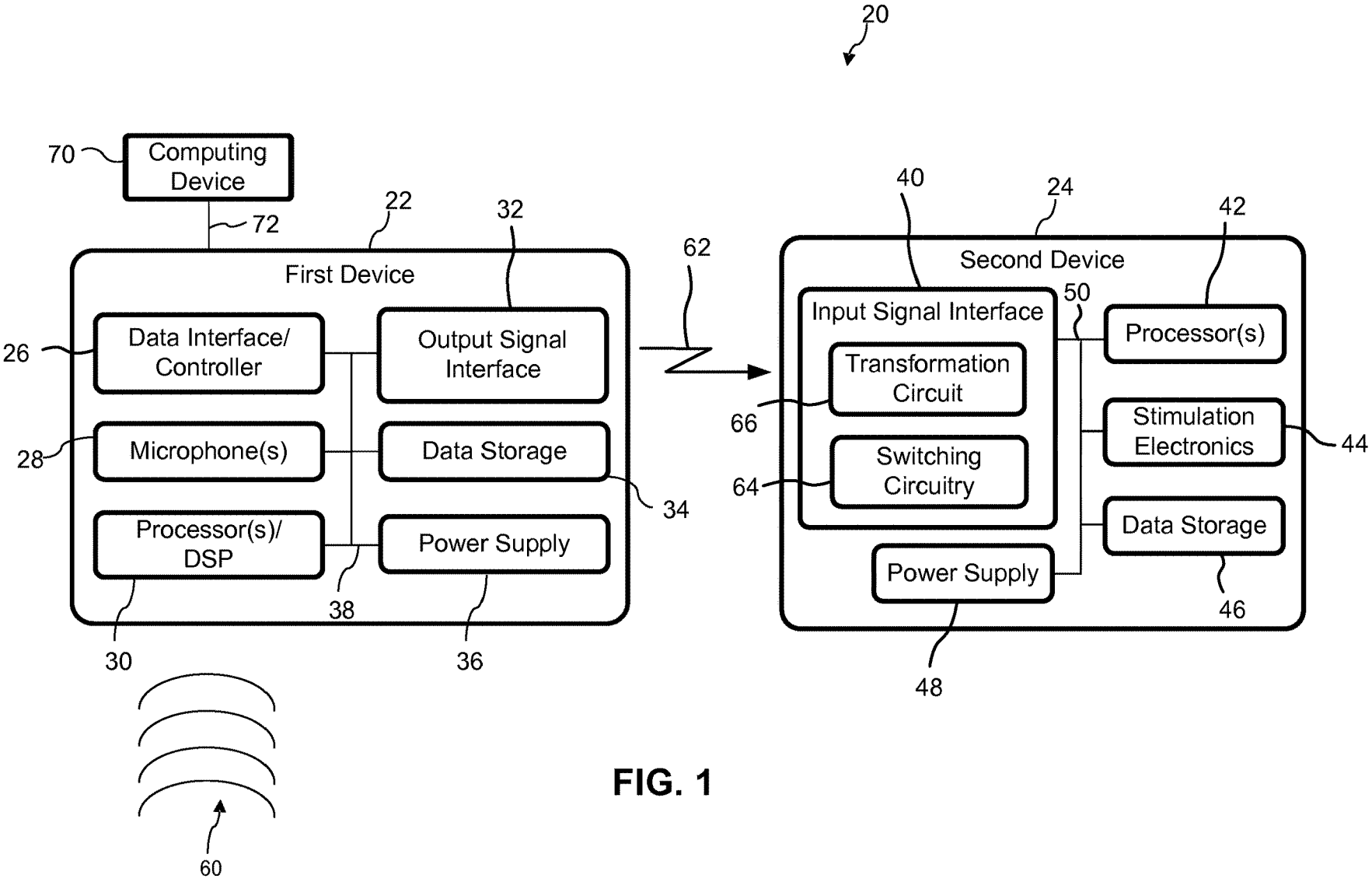
FIG. 1 illustrates a block diagram of a system according to an embodiment of the present disclosure.

Referring now to FIG. 1, an example system 20 includes a first device 22 and a second device 24. In one non-limiting example, the system 20 can include components of a medical device. One such medical device is a hearing prosthesis; for example, a cochlear implant, an acoustic hearing aid, a bone-anchored device, a direct acoustic cochlear stimulation device, an auditory brainstem implant, a bimodal hearing prosthesis, or any other type of hearing prosthesis configured to assist a prosthesis recipient in perceiving sound. In the context of hearing prostheses (and various other medical devices), the first device 22 can be generally external to a recipient and communicate with the second device 24, which can be implanted in the recipient. In other examples, the devices 22, 24 can both be at least partially implanted or can both be at least partially external to the recipient. In yet other examples, the first and second devices 22, 24 may form separate components of a single operational unit. Generally, an implantable unit can be hermetically sealed and adapted to be at least partially implanted in a person.

In FIG. 1, the first device 22 includes a data interface or controller 26 (such as a universal serial bus (USB) controller), one or more microphones 28, one or more processors 30 (such as digital signal processors (DSPs)), an output signal interface 32 (such as a radio frequency (RF) transmitter), data storage 34, and a power supply 36, all of which are illustrated as being coupled directly or indirectly via a wired or wireless link 38. In the example of FIG. 1, the second device 24 includes an input signal interface 40 (such as an RF receiver), one or more processors 42, stimulation electronics 44, data storage 46, and a power supply 48, all of which are illustrated as being coupled directly or indirectly via a wired or wireless link 50.

Generally, the microphone(s) 28 are configured to receive external acoustic signals 60. The microphone(s) 28 can include combinations of one or more omnidirectional or directional microphones that are configured to receive background sounds and/or to focus on sounds from a specific direction, such as generally in front of the prosthesis recipient. Alternatively or in conjunction, the system 20 is configured to receive sound information from other sources, such as electronic sound information received through the data interface 26 of the first device 22 or through the input signal interface 40 of the second device 24.

In one example, the processor 30 of the first device 22 is configured to convert or encode the acoustic signals 60 (or other electronic sound information) into encoded acoustic signals that are applied to the output signal interface 32. In the present example, the output signal interface 32 of the first device 22 is configured to transmit the encoded acoustic signals as output signals 62 to the input signal interface 40 of the second device 24 over an inductive RF link using magnetically coupled coils. Thus, the output signal interface 32 can include an RF inductive transmitter system or circuit. Such an RF inductive transmitter system may further include an RF modulator, a transmitting coil, and associated circuitry for driving the coil to radiate the output signals 62 as RF signals. Illustratively, the RF link can be an On-Off Keying (00K) modulated 5 MHz RF link, although other forms of modulation and signal frequencies can be used in other examples.

As mentioned above, the processor 30 converts the acoustic signals 60 into encoded acoustic signals that are transmitted as the output signals 62 to the RF receiver 40. More particularly, the processor 30 utilizes configuration settings, auditory processing algorithms, and a communication protocol to convert the acoustic signals 60 into acoustic stimulation data that are encoded in the output signals 62. One or more of the configuration settings, auditory processing algorithms, and communication protocol information can be stored in the data storage 34. Illustratively, the auditory processing algorithms may utilize one or more of speech algorithms, filter components, or audio compression techniques. The output signals 62 can also be used to supply power to one or more components of the second device 24.

In the context of a hearing implant, the acoustic stimulation data can be applied to the stimulation electronics 44 of the second device 24 to allow a recipient to perceive the acoustic signals 60 as sound. Generally, the stimulation electronics 44 can include a transducer that provides auditory stimulation to the recipient through electrical nerve stimulation, audible sound production, or mechanical vibration of the cochlea, for example.

In the present example, the communication protocol defines how the stimulation data is transmitted from the first device 22 to the second device 24. For example, the communication protocol can be an RF protocol that is applied after the stimulation data is generated to define how the stimulation data will be encoded in a structured signal frame format of the output signals 62. In addition to the stimulation data, the communication protocol can define how power signals are supplied over the structured signal frame format to provide a more continuous power flow to the second device 24 to charge the power supply 48, for example. Illustratively, the structured signal format can include output signal data frames for the stimulation data and additional output signal power frames. In one example, the output signal power frames include pseudo-data to fill in partially a death time associated with the signal, which facilitates the more continuous power flow to the second device. However, in other examples, additional output signal power frames are not necessary to transmit sufficient power to the second device because there may be enough "one" data cells of the stimulation data to provide power and/or a carrier wave of the output signals 62 may provide sufficient power.

Once the stimulation data and/or power signals are encoded using the communication protocol, the encoded stimulation data and/or power signals can be provided to the output signal interface 32, which can include an RF modulator. The RF modulator can then modulate the encoded stimulation data and/or power signals with the carrier signal, e.g., a 5 MHz carrier signal, and the modulated 5 MHz carrier signal can then be transmitted over the RF link from the output signal interface 32 to the input signal interface 40. In various examples, the modulations can include OOK or frequency-shift keying (FSK) modulations based on RF frequencies between about 100 kHz and 50 MHz.

The second device 24 receives the RF output signals 62 via the input signal interface 40. In one example, the input signal interface 40 includes an RF receiver system or circuit. The RF receiver system can include a receiving coil and associated circuitry for receiving RF signals, such as the output signals 62. The input signal interface 40 can also include switching circuitry or other coupling components 64 and a transformation circuit 66.

In the context of transmitting the output signals 62 between the first device 22 and the second device 24, the system 20 is configured for multiple applications. Illustratively, a first application can be for applying stimulation data (and some power) to the stimulation electronics 44 and a second application can be for providing power signals to charge the power supply 48. In this example, the first application is a lower power use application than the second application. The different power use levels of the first and second applications also correspond to different load conditions for the first and second applications. In order to optimize the communication link between the first device 22 and the second device 24 for these different load conditions, the present system 20 is configured with impedance transforming capabilities for efficiently transmitting the output signals 62 for these different load conditions and applications.

These impedance transforming capabilities are provided, in part, by the coupling components 64 and the transformation circuit 66. Generally, for the first application where the output signals 62 include stimulation data, the coupling components 64 and the transformation circuit 66 are configured to provide the received output signals 62 to the processor 42. The processor 42 is configured to decode and extract the stimulation data and to apply the stimulation data to the recipient via the stimulation electronics 44. For the second application where the output signals 62 include power signals, the coupling components 64 and the transformation circuit 66 are configured to apply the received output signals 62 to charge the power supply 48. As will be described in more detail hereinafter, the transformation circuit 66 functions as an impedance transformation circuit for the first and second applications.

Referring back to the stimulation electronics 44, these electronics can take various forms depending on the type of hearing prosthesis. Illustratively, in embodiments where the hearing prosthesis 20 is a direct acoustic cochlear stimulation (DACS) device, the microphone(s) 28 are configured to receive the acoustic signals 60 and the processor 30 is configured to analyze and encode the acoustic signals into the output signals 62. In this example, the output signals 62 are received by the RF receiver 40, processed by the processor 42, and applied to the DACS recipient's inner ear via the stimulation electronics 44 that, in the present example, includes or is otherwise connected to an auditory nerve stimulator to transmit sound via direct mechanical stimulation.

Similarly, for embodiments where the hearing prosthesis 20 is a bone anchored device, the microphone(s) 28 and the processor 30 are configured to receive, analyze, and encode acoustic signals 60 into the output signals 62. The output signals 62 are received by the RF receiver 40, processed by the processor 42, and applied to the bone anchored device recipient's skull via the stimulation electronics 44 that includes or is otherwise connected to an auditory vibrator to transmit sound via direct bone vibrations, for example.

In addition, for embodiments where the hearing prosthesis 20 is an auditory brain stem implant, the microphone(s) 28 and the processor 30 are configured to receive, analyze, and encode the acoustic signals 60 into the output signals 62. The output signals 62 are received by the RF receiver 40, processed by the processor 42, and applied to the auditory brain stem implant recipient's auditory nerve via the stimulation electronics 44 that, in the present example, includes or is otherwise connected to one or more electrodes.

Similarly, in embodiments where the hearing prosthesis 20 is a cochlear implant, the microphone(s) 28 and the processor 30 are configured to receive, analyze, and encode the external acoustic signals 60 into the output signals 62 that are received by the RF receiver 40, processed by the processor 42, and applied to an implant recipient's cochlea via the stimulation electronics 44. In this example, the stimulation electronics 44 includes or is otherwise connected to an array of electrodes.

In embodiments where the hearing prosthesis 20 is an acoustic hearing aid or a combination electric and acoustic hybrid hearing prosthesis, the microphone(s) 28 and the processor 30 are configured to receive, analyze, and encode acoustic signals 60 into output signals 62 that are applied to a recipient's ear via the stimulation electronics 44 comprising a speaker, for example.

Referring now to the power supplies 36, 48, each power supply provides power to various components of the first and second devices 22, 24, respectively. The power supplies 36, 48 can be any suitable power supply, such as non-rechargeable or rechargeable batteries. In one example, one or more both of the power supplies 36, 48 are batteries that can be recharged wirelessly, such as through inductive charging. Generally, a wirelessly rechargeable battery facilitates complete subcutaneous implantation of the devices 22, 24 to provide fully or at least partially implantable prostheses. A fully implanted hearing prosthesis has the added benefit of enabling the recipient to engage in activities that expose the recipient to water or high atmospheric moisture, such as swimming, showering, saunaing, etc., without the need to remove, disable or protect, such as with a water/moisture proof covering or shield, the hearing prosthesis. A fully implanted hearing prosthesis also spares the recipient of stigma, imagined or otherwise, associated with use of the prosthesis.

Referring again to the data storage 34, 46, these components generally include any suitable volatile and/or non-volatile storage components. Further, the data storage 34, 46 may include computer-readable program instructions and perhaps additional data. In some embodiments, the data storage 34, 46 stores data and instructions used to perform at least part of the herein-described methods and algorithms and/or at least part of the functionality of the systems described herein. Although the data storage 34, 46 in FIG. 1 are illustrated as separate blocks, in some embodiments, the data storage can be incorporated into other components of the devices 22, 24, such as the processor(s) 30, 42, respectively.

The system 20 illustrated in FIG. 1 further includes a computing device 70 that is configured to be communicatively coupled to the first device 22 (and/or the second device 24) via a connection or link 72. The link 72 may be any suitable wired connection, such as an Ethernet cable, a Universal Serial Bus connection, a twisted pair wire, a coaxial cable, a fiberoptic link, or a similar physical connection, or any suitable wireless connection, such as Bluetooth, Wi-Fi, WiMAX, inductive or electromagnetic coupling or link, and the like.

In general, the computing device 70 and the link 72 are used to operate the system 20 in various modes. In a first example, the computing device 70 and the link 72 are used to develop and/or load a recipient's configuration data on the system 20, such as via the data interface 26. In another example, the computing device 70 and the link 72 are used to upload other program instructions and firmware upgrades, for example, to the system 20. In yet other examples, the computing device 70 and the link 72 are used to deliver data (e.g., sound information) and/or power to the system 20 to operate the components thereof and/or to charge one or more of the power supplies 36, 48. Still further, various other modes of operation of the prosthesis 20 can be implemented by utilizing the computing device 70 and the link 72.

The computing device 70 can further include various additional components, such as a processor and a power source. Further, the computing device 70 can include user interface or input/output devices, such as buttons, dials, a touch screen with a graphic user interface, and the like, that can be used to turn the one or more components of the system 20 on and off, adjust the volume, switch between one or more operating modes, adjust or fine tune the configuration data, etc. Thus, the computing device 70 can be utilized by the recipient or a third party, such as a guardian of a minor recipient or a health care professional, to control the system 20.

Various modifications can be made to the system 20 illustrated in FIG. 1. For example, user interface or input/output devices can be incorporated into the first device 22 or the second device 24. In another example, the second device 24 can include one or more microphones. Generally, the system 20 may include additional or fewer components arranged in any suitable manner. In some examples, the system 20 may include other components to process external audio signals, such as components that measure vibrations in the skull caused by audio signals and/or components that measure electrical outputs of portions of a person's hearing system in response to audio signals.

Figure 2:
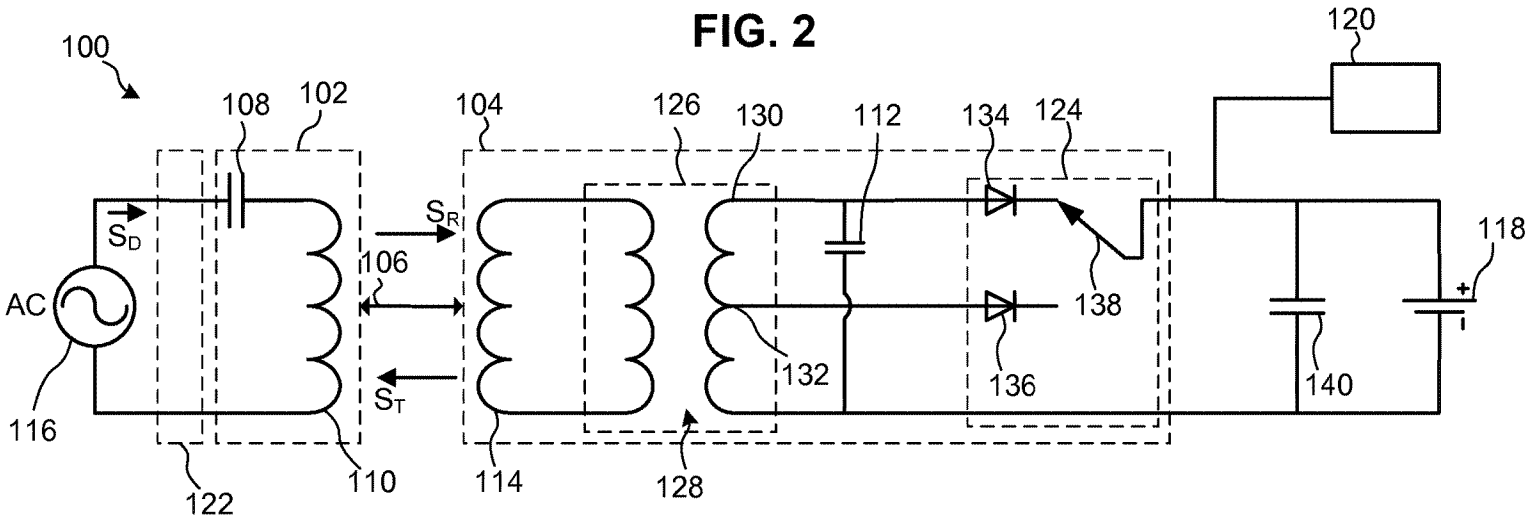
FIG. 2 illustrates a partial block, partial electrical schematic diagram of a system according to an embodiment of the present disclosure.

Referring now to FIG. 2, a partial block, partial electrical schematic diagram is illustrated of a system 100, which also shows an implementation of various components of the system 20 of FIG. 1. The system 100 of FIG. 2 includes a transmitter circuit 102 (similar in function to the output signal interface 32) and a receiver circuit 104 (similar in function to the input signal interface 40). In the present example, the transmitter circuit 102 and the receiver circuit 104 are associated with separate units or elements of the system 100, such as an external unit and an internal unit of a hearing prosthesis, respectively. The transmitter circuit 102 and the receiver circuit 104 are configured to deliver electrical signals therebetween via a link 106, such as an RF link operating in the magnetic or electric near-field. Generally, the circuits 102, 104 are configured to deliver electrical signals that include data and/or power over the link 106.

As illustrated in FIG. 2, the transmitter circuit 102 is modeled as a series LC tank circuit that includes a capacitor 108 and a primary coil 110 and the receiver circuit 104 can be modeled as a parallel LC tank circuit that includes a capacitor 112 and a secondary coil 114. In other examples, the transmitter and receiver circuits 102, 104 can include other arrangements and/or additional or fewer components.

The system 100 also includes a signal generator 116 coupled to the transmitter circuit 102. The signal generator 116 is configured to generate an electrical signal $S_D$ that is supplied to the transmitter circuit 102. More particularly, the electrical signal $S_D$ generated by the signal generator 116 and supplied to the transmitter circuit 102 induces or otherwise generates a corresponding electrical signal $S_R$ in the receiver circuit 104 to deliver power and/or data over the link 106 to the receiver circuit 104 and other components coupled thereto. In the present example, the signal generator 116 includes an oscillating power source that generates an alternating current electrical signal $S_D$ that is supplied to the transmitter circuit 102. The alternating current of the signal $S_D$ generates a magnetic field from the primary coil 110 and the magnetic field induces the electrical signal $S_R$ in the secondary coil 114.

As illustrated in FIG. 2, a power source 118 and system electronics 120 can be coupled to the receiver circuit 104. Generally, the system electronics 120 include one or more hearing prosthesis electronics or components discussed above in relation to FIG. 1 (such as one or more of components 42-46). In addition, FIG. 2 illustrates system electronics 122 coupled to the transmitter circuit 102. Generally, the system electronics 122 include one or more hearing prosthesis electronics or components discussed above in relation to FIG. 1 (such as one or more of components 26-30 and 34-36).

FIG. 2 also illustrates coupling components or switching circuitry 124 and a transformation circuit 126 that are coupled to the secondary coil 114. The switching circuitry 124 is configured to selectively couple the power source 118 and the system electronics 120 to the secondary coil 114 in accordance with different operating modes and load conditions. More particularly, the switching circuitry is configured to couple the power source 118 and the system electronics 120 to the secondary coil 114 through the transformation circuit.

In the illustrated example, the transformation circuit 126 includes a transformer 128 with a variable turns ratio. As seen in FIG. 2, the variable turns ratio is represented by a first transformer tap 130 and a second transformer tap 132. In other examples the transformer 128 can include additional taps associated with other variable turns ratios. Generally, the variable turns ratios are used to transform the load impedance for the different applications or load conditions. In other examples, different load transforming circuits can be used, such as using a capacitive divider coupled to the secondary coil 114 or using a combination of a full-wave rectifier and a voltage doubler coupled to the secondary coil 114. Such a capacitive divider, rectifier, or voltage doubler can take any variety of suitable, known configurations.

Further, in this example, the switching circuitry 124 includes diodes 134, 136 and a switch 138. The switch 138 is configured to selectively couple to one or the other of the diodes 134, 136. More particularly, when the switch 138 is in a first position, as illustrated in FIG. 2, the switch couples the system electronics 120 to receive electrical signals via the first transformer tap 130. When the switch 138 is in a second position, the switch couples the power source 118 to receive electrical signals via the second transformer tap 132. The transformer taps 130, 132 represent different turns ratios that are configured to transform the impedance of the system 100 to optimal values for the different load conditions. In another example, the switching circuitry 124 can include an additional switch coupled to the power supply 118 to disconnect the power supply from receiving the electrical signal $S_R$ when the electrical signal is being applied to the system electronics 120.

The system 100 of FIG. 2 also includes a rectifier circuit coupled to the receiver circuit 104 to convert the electrical signals $S_R$ generated in the receiver circuit, which are typically alternating current signals, to direct current signals for use by one or more of the system electronics 120 and the power source 118. In the present example, the rectifier circuit includes one or more of the diodes 134, 136 and a capacitor 140. Other rectifier circuit configurations can be used in other examples.

Illustratively (and with reference to FIGS. 1 and 2), the system electronics 122 coupled to the transmitter circuit 102 include a microphone 28 and a processor 30 for receiving an acoustic signal 60 and encoding the acoustic signal into an electrical signal $S_D$ that is supplied to the transmitter circuit 102 by the signal generator 116. The signal generator 116 can also generate the electrical signal $S_D$ supplied to the transmitter circuit 102 that is independent of the acoustic signal 60. As described above, the electrical signal $S_D$ supplied to the transmitter circuit 102 induces a corresponding electrical signal $S_R$ in the receiver circuit 104. The induced electrical signal $S_R$ is supplied to other components coupled to the receiver circuit 104, such as the power source 118 and the system electronics 120, to operate the system 100 in one or more modes or applications. More particularly, the induced electrical signal $S_R$ is supplied through the transformation circuit 126 and the switching circuitry 124 to other components coupled to the receiver circuit 104.

In a first example application, the induced electrical signal $S_R$ is supplied to a processor 42 and stimulation electronics 44 of the system electronics 120 to encode the electrical signal as an output signal applied to a user of the system 100. In a second application, the induced electrical signal $S_R$ is supplied to the power source 80 to charge the power source. Other applications are also possible, such as supplying the induced electrical signal $S_R$ to a data storage 46 of the system electronics 120 to load program instructions, software, firmware, data, etc. for use by the system 100.

In these examples, the first application of providing the electrical signal to the stimulation electronics 44 is a lower power use and a higher impedance application than the second application of charging the power supply 48. As described above, the switching circuitry 124 and the transformation circuit 126 are used to transform the load impedance to improve the efficiency for the first and second applications. More particularly, in the first position, the switch 138 couples the system electronics 120 to receive the electrical signal via the first transformer tap 130. In the second position, the switch 138 couples the power source 118 to receive the electrical signal via the second transformer tap 132. In this example, the first transformer tap 130 represents a higher turns ratio than the second transformer tap 132. Illustratively, the first turns ratio can be 1:4 or 1:6 and the second turns ratio can be 1:2 or 1:3. This configuration functions to make the electrical signal transmission more efficient for the different applications. Further, the transformer 128 also provides electrical isolation for user safety by blocking leakage currents from the stimulation electronics 44.

The switch 138 can be controlled to transition between the first and second positions for the first and second applications, respectively, by a processor, such as the processor 42 of FIG. 1. In one example, the processor determines whether the induced electrical signal $S_R$ is intended for the first application or the second application by monitoring the signal $S_R$ induced at the secondary coil 114. More particularly, the signal $S_R$ can include encoded data indicative of the first or second application. In another example, different power levels of the signal $S_R$ can be indicative of the first or second application. In these examples, the processor is configured to monitor the state of the switch 138 and to transition the switch between the first and second positions in accordance with the determined application. The state of the switch may be stored and recalled, such that the processor can know the state of the switch even upon start-up or system reset from low-power conditions, for example. Alternatively, the state of the switch can be reset to a known state upon start-up or system reset.

Figure 3:
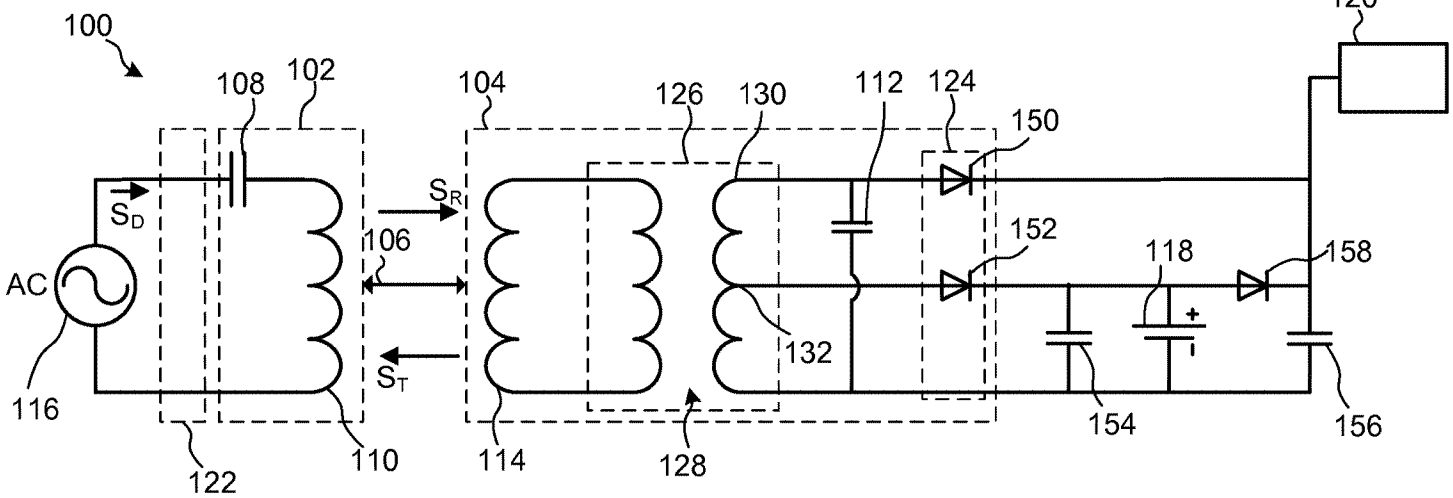
FIG. 3 illustrates a partial block, partial electrical schematic diagram of a system according to another embodiment of the present disclosure.

FIG. 3 illustrates another variation in the switching circuitry 124, which, in this example, includes diodes 150, 152. FIG. 3 also illustrates capacitors 154, 156 and diode 158, which function generally as rectifying and power smoothing components. In this example, the diodes 150, 152 are coupled to the system electronics 120 and the power source 118 in a manner to utilize the power level of the induced signal $S_R$ to selectively couple the system electronics and the power source to the transformer taps 130, 132. More particularly, in one example, for the first application, the signal generator 116 induces the electrical signal $S_R$ with a voltage of around 4V for operating the system electronics 120. Neglecting any forward voltage drop in the diodes 150, 152, the peak voltage at the transformer tap 130 (with a turns ratio of 1:4, for example) is also around 4V. In this example, the voltage at the second tap 132 (with a turns ratio of 1:2, for example) is around 2V. Assuming that the voltage of the power source 118 is between around 3.5V-4V, this causes the diode 152 to not be forward biased, which blocks the electrical signal $S_R$ from the power source 118. In this application, the power source 118 is effectively disconnected from the transformer 128 and the higher turns ratio at the tap 130 is used to operate the system electronics 120.

For the second application, the signal generator 116 induces the electrical signal $S_R$ with a voltage above around 8V. In this example, the voltage at the second tap 132 is higher than 4V, thus forward biasing the diode 152 and providing the electrical signal $S_R$ to charge the power source 118 via the more efficient lower turns ratio of the tap 132. Thus the diodes 150, 152 can function as switching circuitry simply based on the input power level, which is controlled, at least in part, by the signal generator 116 and processor coupled thereto (e.g., the processor 30 of FIG. 1).

The transformation circuits 126 described herein are generally configured to provide a relatively coarse impedance matching adjustment. Additional fine-tuning can also be accomplished as disclosed herein. In one example, a duty cycle adjustment of the electrical signal $S_R$ is performed to further improve the impedance matching of the system. In this example, the duty cycle adjustment can be performed by the signal generator 116, as will be described in more detail in relation to FIGS. 4-7.

Referring now to FIG. 4, a block diagram of another system 180 similar to FIGS. 2-3 is illustrated. The system 180 in the example of FIG. 4 includes a first element 182, such as an external unit of a hearing prosthesis, and a second element 184, such as an internal unit of a hearing prosthesis. Further, the system 180 includes a transmitter circuit 102, a receiver circuit 104, a link 106 between the circuits 102, 104, and a signal generator 116 similarly to FIGS. 2-3.

In one example, the transmitter circuit 102 is a first antenna or coil structure and the receiver circuit 104 is a second antenna or coil structure. Further, in the present example, the signal generator 116 is an RF signal generator with frame or duty cycle control, as will be described in more detail hereinafter. Generally, the signal generator 116 of FIG. 4 receives a data input 186 and a frame control input 188 that can be utilized to generate a desired signal that is supplied to a driver 190. The driver 190 is configured to boost or amplify the signal from the signal generator 186 and may include, for example, a Class-D or Class-E amplifier with one or more MOSFET's or bipolar transistors. In addition, the system 180 of FIG. 4 includes a power supply 192 coupled to the driver 190 and/or other components of the first element 182. The first element 182 also includes an impedance matching component 194 coupled between the driver 190 and the transmitter circuit 102.

In the second element 184 of FIG. 4, an impedance matching component 196 is coupled to the receiver circuit 104 and a power and data extractor 198 is coupled to the impedance matching component. The impedance matching components can include variable turns ratio transformers, capacitance dividers, rectifiers, voltage doublers, etc., as described above. The power and data extractor 198 generates a power output 200 and a data output 202. FIG. 4 illustrates the power output 200 being supplied to a load 204. Alternatively or in combination, the data output 202 can also be supplied to the load 204. In various examples, the load 204 includes such components as the power supply 118 and/or the system electronics 120 described above.

Referring now to FIG. 5, a block diagram of one example of the RF signal generator with frame control component 116 of FIG. 4 is illustrated. In FIG. 5, the signal generator 116 includes the data input 186 and the control input 188. The data input 186 is coupled to a block encoder 210, for example, a five cycle per cell encoder, for encoding data in the signal provided to the transmitter circuit 102 and transferred to the receiver circuit 104. The frame control input 188 is coupled to a frame or duty cycle controller 212, which is configured to vary a frame or duty cycle of the signal provided to the transmitter circuit 102, as will be described in more detail hereinafter. The frame controller 212 is also coupled to the block encoder 210 and to a modulator 214. As shown in the example of FIG. 5, an RF signal generator 216, which can generate a sinusoidal signal at 5 MHz, for example, is also coupled to the modulator 214. An output 218 from the modulator 214 is a frame or duty cycle controlled output signal that can be transferred from the transmitter circuit 102 to the receiver circuit 104.

Generally, the systems 100, 180 can be configured to control or adjust the efficiency of the link 106 to deliver data and/or power between the transmitter circuit 102 and the receiver circuit 108. However, in some situations, the efficiency of the link 106 and, thus, the configuration and control of the system is a function of a load condition of an operating mode of the system.

In one example, the power transfer efficiency of the link 106 in FIGS. 2-3 can be approximated as a function of an effective load resistance $R_L$ looking after the capacitor 112. Illustratively, if the electrical signal $S_D$ generated by the signal generator 116 is a constant sinusoidal signal, the effective load resistance $R_L$ looking into an ideal half-wave rectifier circuit coupled to the capacitor 112 can be approximated by the following Equation 1:

$$R_{L_HW}=R/2 \tag{1}$$

In Equation 1, R is the resistance coupled to an output of the rectifier and can be measured in ohms or any other suitable unit. In the present example, the resistance R varies depending on an operating mode of the system. Generally, $R=R_P$ in a first operating mode when the power supply 118 is being charged and $R=R_E$ in a second operating mode when supplying power and/or data to the system electronics 120, such as when the power supply is depleted. Further, the resistance $R_E$ can be one or more different resistance values depending on particular component(s) that are included in the system electronics 120 and/or on particular component(s) that are in use during an operating mode.

Illustratively, FIG. 6 shows examples of a first operating mode 230 during which the power supply 118 is charged and a second operating mode 232 during which power and data are supplied to the system electronics 120. In the first operating mode 30 of FIG. 6, power is supplied to the power source 118 through a battery charger component 234 and a battery protection circuit 236. Further, a feedback loop 238 can provide feedback data to the battery charger 234 for use in charging the power source 118. Such feedback data may include, for example, temperature, current, and voltage information related to the power supplied to the battery protection circuit 236.

In the second operating mode 232, signals including data and power are supplied to the system electronics 120 through a decoder/digital logic component 240 for decoding the data in the received signals and a driver 242 for amplifying the signals transferred to the system electronics 120. In FIG. 6, the system electronics 120 can include one or more of an actuator, vibrator, or other stimulator configured to apply output signals to a recipient.

Referring back to FIG. 4, varying load conditions for different operating modes of the system 180 complicate the process of configuring the system for optimal efficiency of the link 106. Prior systems have implemented a compromise design that results in sub-optimal performance or have included additional components for dynamically transforming the load conditions, at the expense of adding size, complexity, and/or electrical losses.

In contrast, the disclosed embodiments can be configured to optimize or at least improve the relative efficiency of the link 106 for different operating modes by controlling the electrical signals $S_D$ generated by the signal generator 116 and supplied to the transmitter circuit 102. More particularly, a duty cycle of the electrical signals $S_D$ generated by the signal generator 116 is varied for different operating modes and load conditions to optimize or at least improve the relative power transfer efficiency of the link 106. If the electrical signal $S_D$ generated by the signal generator 116 is provided to the transmitter circuit 102 in bursts, rather than continuously, the effective load resistance $R_L$ looking into an ideal half-wave rectifier coupled to the capacitor 112 of FIGS. 2-3 can be approximated by the following Equation 2:

$$R_{L_HW}=D*(R/2) \quad (2)$$

In Equation 2, $R_L$ Hw is the resistance coupled to an output of the rectifier and D is the duty cycle of the electrical signal $S_D$. Generally, the duty cycle D is a fraction of time that the electrical signal $S_D$ is on or being generated by the signal generator 116 and supplied to the transmitter circuit 102. Using the relation in Equation 2, various components the system 180 can be configured to optimize the efficiency of the link 106 for a particular load condition or resistance and the duty cycle of the electrical signal $S_D$ generated by the signal generator 116 can be varied depending on the specific load condition. As a result, the primary and second coil 110, 114 arrangement can be utilized to provide an efficient link 106 for different load conditions.

Illustratively, the system 180 can be operated in a first mode to charge a power supply 118 and a second mode to deliver data and/or power to system electronics 120. In the first mode, the power source 118 is a 4 V Li-ion battery that should be charged with a 20 mA charge current. In this case, the resistance looking into the power source 118 is $R_P$=4V/0.02 A=200 ohms. The load resistance $R_E$ looking into the system electronics 120, however, is typically significantly higher. For example, if the system electronics 120 requires 2 V and consumes only a 2 mA current, the resistance looking into the system electronics is $R_E$=2V/0.002 A=1000 ohms. For these parameters, an electrical signal $S_D$ can be generated with a duty cycle of 95% to charge the power source 118 and an electrical signal $S_D$ can be generated with a duty cycle of 19% to energize the system electronics 120. With these duty cycle values, the effective load resistance looking into the rectifier, as given by Equation 2, is the same in both cases to provide optimal power transfer efficiencies for the first and second modes. Generally, higher duty cycles are used when the load condition draws high currents and lower duty cycles are used when the load condition draws small currents.

In various examples of the present disclosure, such duty-cycle adjustments are used together with the impedance matching performed by the transformation circuit 126 described above. Generally, the transformation circuit 126 is configured to support a few discrete load values, for example, because the circuit includes a transformer with a limited number of taps. However, the transformation circuit can support a relatively wide range of load values. In this example, the transformation circuit is used as a relatively coarse impedance matching adjustment and the duty-cycle adjustment is used as a fine-tuning, real-time impedance matching adjustment. This multiple stage impedance matching allows the system to maintain the duty cycles at higher rates, which helps to avoid certain issues, such as low data rates, undesirable voltage ripples, and electro-magnetic current issues.

Figure 7:
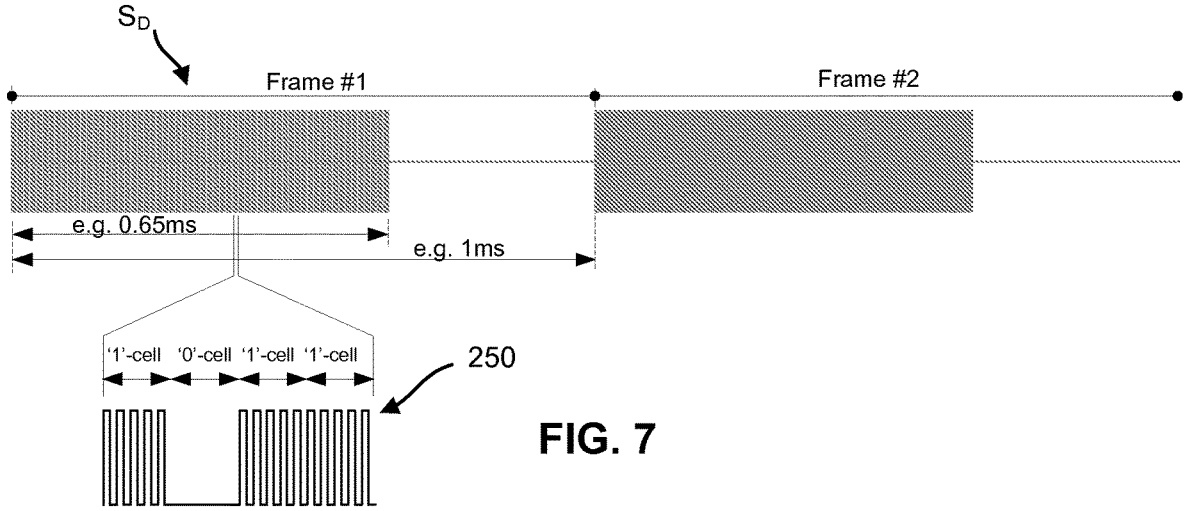
FIG. 7 illustrates an electrical signal having a 65% frame duty cycle in accordance with an embodiment of the present disclosure.

Referring to FIG. 7, a non-limiting example of the electrical signal $S_D$ at a duty cycle of about 65% is illustrated. In the example of FIG. 7, the duty cycle of a signal is generally considered to be a ratio of an On time to the total frame time or On and Off time. For example, in FIG. 7, the total frame time is 1 ms and the On time is 0.65 ms, which results in a 65% duty cycle. Further, FIG. 7 illustrates how data can be encoded in the electrical signal $S_D$, for example, using a five cycle per cell encoding. More particularly, within the On time of the signal $S_D$, binary one's and zero's can be encoded as shown in the enlarged portion 250. Further, the signal $S_D$ need not be a square wave, as generally illustrated. Rather, each signal burst can be modulated using known techniques, such as on-off keying (OOK), frequency-shift keying (FSK), phase-shift keying (PSK), and the like, to transfer power and/or data over the link 106.

In other examples, the system 180 can be operated in additional modes and the duty cycle of the electrical signal $S_D$ generated by the signal generator 116 can be adjusted accordingly. In one instance, the additional modes include different use cases that result in different load conditions. For example, the system 180 can be a hearing prosthesis and the different use cases may include an omnidirectional microphone mode, a directional microphone mode, a telephone mode, an audio/visual mode, etc. Another use case includes loading program instructions, such as firmware and software, over the link 106 and storing such program instructions in a data storage 46 of the system electronics 120.

The additional modes may also be associated with different duty cycles for different coupling factors between the transmitter circuit 102 and the receiver circuit 104. The different coupling factors can be the result of different distances between the transmitter and receiver circuits 102, 104 and different media between the transmitter and receiver circuits. For example, different coupling factors can be the result of different skin flap characteristics and thicknesses that overlay an implanted receiver circuit. The coupling factor can be measured during a fitting or configuration process of the system 180 and/or can be monitored dynamically and accounted for while the system is in use.

Still further, the signal generator 116 can dynamically adjust the duty cycle of the electrical signals $S_D$ to account for variations in the load conditions for different operating modes. The variations in the load conditions can be caused by a variety of factors, including the coupling factors and different operating modes described above. Further, variations in the load conditions can be caused by an amount of stimulation received by a hearing prosthesis, a level of signal processing, and other factors. The signal generator 116 can be configured to monitor current load conditions and vary the duty cycle of the electrical signal $S_D$ in real time to maintain improved efficiency of the link 106. In one example, the current load conditions can be derived from electrical signals $S_T$ (shown in FIGS. 2-3) that are fed back from the receiver circuit 104 to the transmitter circuit 102 through the link 106 and to the signal generator 116, which monitors the current load conditions and adjusts the duty cycle of the electrical signal $S_D$ accordingly.

Figure 8:
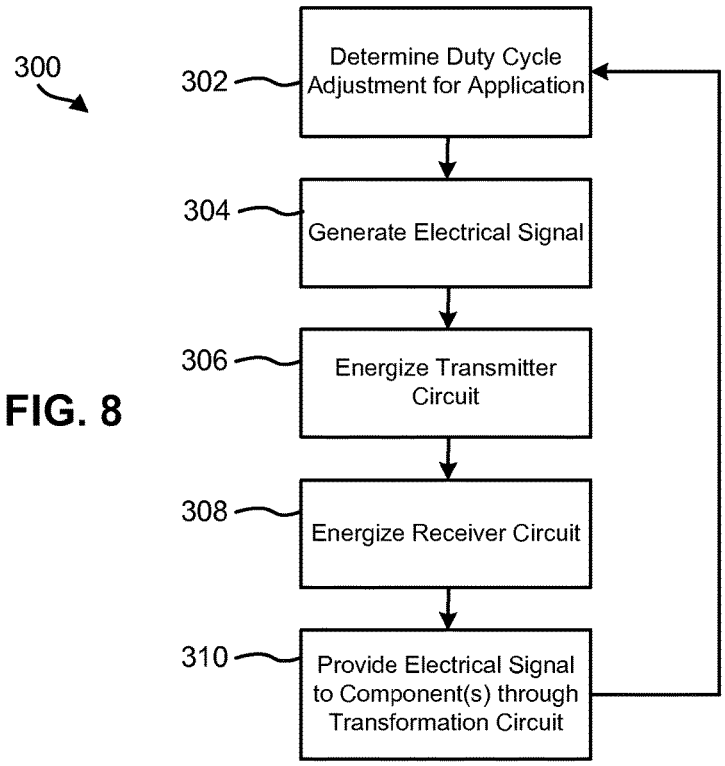
FIG. 8 is a flowchart showing a method or algorithm for optimizing a link for different applications or operating modes according to an embodiment.

Referring now to FIG. 8 and with further reference the description above, one example method 300 is illustrated for optimizing a link for different load conditions. For illustration purposes, some features and functions are described herein with respect to hearing prostheses. However, various features and functions may be equally applicable to other types of medical and non-medical devices.

The method 300 of FIG. 8 can be implemented by the systems 20, 100, 180 of FIGS. 1-4. Further, the method 300 may include one or more operations, functions, or actions as illustrated by one or more of blocks 302-310. Although the blocks 302-310 are illustrated in a sequential order, the blocks may also be performed in parallel, and/or in a different order than described herein. The method 300 may also include additional or fewer blocks, as needed or desired. For example, the various blocks 302-310 can be combined into fewer blocks, divided into additional blocks, and/or removed based upon a desired implementation.

In addition, each block 302-310 may represent a module, a segment, or a portion of program code, that includes one or more instructions executable by a processor for implementing specific logical functions or steps in the process. The program code may be stored on any type of computer readable medium or storage device including a disk or hard drive, for example. The computer readable medium may include a non-transitory computer readable medium, such as computer-readable media that stores data for short periods of time like register memory, processor cache, and Random Access Memory (RAM). The computer readable medium may also include non-transitory media, such as secondary or persistent long term storage, like read only memory (ROM), optical or magnetic disks, compact-disc read only memory (CD-ROM), etc. The computer readable medium may also include any other volatile or non-volatile storage systems. The computer readable medium may be considered a computer readable storage medium, for example, or a tangible storage device. In addition, one or more of the blocks 302-310 may represent circuitry that is wired to perform the specific logical functions of the method 300.

In the method 300, the block 302 determines a duty cycle adjustment for an application or operating mode of the system. More particularly, the block 302 determines the duty cycle for optimal efficiency of the application or operating mode. As discussed above, such duty cycle adjustment and optimal efficiency can vary based on the application and can be related to a number of factors, such as a load condition required by the application and a coupling factor of a data/power transfer link. Further, the duty cycle can be dynamically varied based on changing load conditions that can be continuously monitored, as described generally above.

The block 304 generates an electrical signal with the duty cycle adjustment determined by the block 302. In one example, the block 304 controls the signal generator 116 to generate the electrical signal $S_D$ with the determined duty cycle. In the present example, other parameters of the electrical signal $S_D$ are also determined based on the given application, such as an amplitude, frequency, period, etc. to encode data and/or deliver power, as needed for the application.

In FIG. 8, the block 306 supplies the electrical signal, such as the signal $S_D$, to energize a transmitter circuit, such as the transmitter circuit 102 of FIG. 2. The block 308 energizes a receiver circuit, such as the receiver circuit 104 of FIG. 2, in response to the block 306. In one example, the electrical signal $S_D$ energizes the transmitter circuit 102 to induce a corresponding electrical signal $S_R$ in the receiver circuit 104 via the link 106.

Thereafter, the block 310 provides the electrical signal to one or more components in accordance with the given application; for example, the electrical signal $S_R$ can be provided to hearing prosthesis electronics to provide power and data thereto or to charge a power source. More particularly, at the block 310, the system applies the electrical signal through a transformation circuit, as described above, for the given application.

In the method 300 of FIG. 8, after the block 310, control passes back to the block 302 to determine whether the duty cycle is the same or has changed and the processing of blocks 302-310 can be performed thereafter, as described above.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A hearing prosthesis, comprising:

a transmitter circuit configured to transmit wireless signals to a receiver circuit over a wireless communication link; and a signal generator configured to operate in first and second modes to generate electrical signals useable to drive the transmitter circuit to transmit the wireless signals, wherein the signal generator includes a frame controller configured to set a first duty cycle of the electrical signals to drive the transmitter circuit in the first mode and to set a second duty cycle to drive the transmitter circuit in the second mode, and wherein the first and second duty cycles set for each of the first and second modes, respectively, are selected based on one or more conditions of the wireless communication link when transmitting wireless signals in the first and second modes, respectively.

2. The hearing prosthesis of claim 1, wherein the one or more conditions comprise a load condition associated with the wireless communication link, and wherein the frame controller is configured to set a duty cycle of the electrical signals provided to the transmitter circuit in each of the first and second modes based on a load condition associated with the wireless communication link when transmitting wireless signals in the first and second modes, respectively.

3. The hearing prosthesis of claim 1, wherein the one or more conditions comprise a coupling factor associated with the wireless communication link, and wherein the frame controller is configured to set a duty cycle of the electrical signals provided to the transmitter circuit in each of the first and second modes based on a current coupling factor associated with the wireless communication link when transmitting wireless signals in the first and second modes, respectively.

4. The hearing prosthesis of claim 1, wherein the transmitter circuit comprises a transmitter coil, and wherein the wireless communication link is a radio frequency induction link.

5. The hearing prosthesis of claim 1, wherein the first mode is associated with at least a first link condition for transmitting power signals that are configured for use in recharging a power supply, and wherein the second mode is associated with at least a second link condition for transmitting at least stimulation data, wherein the at least first and the at least second link conditions are different from one another.

6. The hearing prosthesis of claim 5, wherein in the second mode the signal generator is configured to generate the electrical signals based on audio data.

7. The hearing prosthesis of claim 1, further comprising:

a driver coupled to an output of the signal generator and configured to amplify the electrical signals generated by the signal generator; and an impedance matching component coupled between the driver and the transmitter circuit.

8. The hearing prosthesis of claim 7, wherein the impedance matching component includes a variable turn ratio transformer.

9. A hearing prosthesis, comprising:

a primary coil; and a signal generator coupled to the primary coil and configured to energize the primary coil to transmit signals to a secondary coil, wherein the signal generator is configured to energize the primary coil to transmit electrical signals to the secondary coil over an inductive link at a first duty cycle for operation in a first mode and to energize the primary coil to transmit electrical signals over the inductive link to the secondary coil at a second duty cycle for operation in a second mode, wherein the first and second duty cycles are different from one another and are set based on at least one of a load condition or a coupling factor of the inductive link when transmitting electrical signals in each of the first and second modes.

10. The hearing prosthesis of claim 9, wherein the first mode is for transmitting stimulation data from the primary coil to the secondary coil, and wherein the second mode is for transmitting power signals from the primary coil to the secondary coil that are configured for use in recharging an implantable power supply.

11. The hearing prosthesis of claim 10, wherein in the first mode the signal generator is configured to energize the primary coil based on audio data.

12. The hearing prosthesis of claim 9, wherein the second mode is a higher power use mode and the second mode is a lower power use mode.

13. The hearing prosthesis of claim 9, wherein the first mode is a higher impedance mode and the second mode is a lower impedance mode.

14. The hearing prosthesis of claim 9, wherein the inductive link has different load conditions in each of the first and second modes.

15. The hearing prosthesis of claim 14, wherein the signal generator is configured to monitor current load conditions of the inductive link and to set at least one of the first or second duty cycles in real-time based on the current load conditions of the inductive link.

16. A method, comprising:

generating, with a signal generator of an external unit of a hearing prosthesis, oscillating electrical signals in accordance with a first and second modes;

energizing a transmitter circuit with the oscillating electrical signals generated in accordance with the first and second modes to transmit the electrical signals generated in accordance with the first and second modes to a receiver circuit disposed in an implantable unit of the hearing prosthesis via an inductive link coupling the transmitter circuit to the receiver circuit; and setting a duty cycle of the oscillating electrical signals in each of the first and second modes based on one or more conditions of the inductive link when transmitting the electrical signals in the first and second modes, respectively.

17. The method of claim 16, wherein the one or more conditions comprise a load condition associated with the inductive link, and wherein setting a duty cycle of the oscillating electrical signals in each of the first and second modes based on one or more conditions of the inductive link comprises:

setting the duty cycle of the oscillating electrical signals in each of the first and second modes based on a load condition associated with the inductive link when transmitting the electrical signals in the first and second modes, respectively.

18. The method of claim 16, wherein the one or more conditions comprise a coupling factor associated with the inductive link, and wherein setting a duty cycle of the oscillating electrical signals in each of the first and second modes based on one or more conditions of the inductive link comprises:

setting the duty cycle of the oscillating electrical signals in each of the first and second modes based on a coupling factor associated with the inductive link when transmitting the electrical signals in the first and second modes, respectively.

19. The method of claim 16, wherein the first mode is for transmitting power signals that are configured for use in recharging a power supply, and wherein the second mode is for transmitting stimulation data, and wherein the method comprises:

in the second mode, generating the oscillating electrical signals based on audio data.

20. The method of claim 19, wherein the second mode is a higher power use mode and the second mode is a lower power use mode.

21. The method of claim 19, wherein the first mode is a higher impedance mode and the second mode is a lower impedance mode.

* * * * *